US006494269B2

(12) United States Patent
French et al.

(10) Patent No.: US 6,494,269 B2
(45) **Date of Patent: *Dec. 17, 2002**

(54) DOWNHOLE APPARATUS FOR CONTROLLING FLUID PRESSURE

(75) Inventors: Clive John French, Aberdeen (GB); Glen Batten, Castleford (GB)

(73) Assignee: Baker Hughes Incorporated, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/776,564

(22) Filed: Feb. 2, 2001

(65) Prior Publication Data

US 2001/0007284 A1 Jul. 12, 2001

Related U.S. Application Data

(63) Continuation of application No. 09/117,513, filed on Mar. 3, 1999, now Pat. No. 6,230,808.

(30) Foreign Application Priority Data

Feb. 3, 1996 (GB) ..... 9602211
Jul. 5, 1996 (GB) ..... 9614101

(51) Int. Cl.[7] ..... E21B 34/08
(52) U.S. Cl. ..... 166/386; 166/323; 166/332.8
(58) Field of Search ..... 166/321, 323, 166/332.8, 332.4, 317, 386, 375

(56) References Cited

U.S. PATENT DOCUMENTS

| | | | | | |
|---|---|---|---|---|---|
| 4,475,599 | A | * | 10/1984 | Akkerman | 166/323 |
| 5,125,457 | A | * | 6/1992 | Meaders | 166/322 |
| 5,263,847 | A | * | 11/1993 | Akkerman et al. | 251/303 |
| 5,323,859 | A | * | 6/1994 | Smith et al. | 166/321 |
| 5,636,661 | A | * | 6/1997 | Moyes | 137/614.2 |
| 5,682,921 | A | | 11/1997 | Rawson et al. | |
| 5,918,858 | A | | 7/1999 | Rawson et al. | |
| 6,230,808 | B1 | * | 5/2001 | French et al. | 166/323 |

* cited by examiner

*Primary Examiner*—David Bagnell
*Assistant Examiner*—Zakiya Walker
(74) *Attorney, Agent, or Firm*—Steve Rosenblatt

(57) ABSTRACT

Downhole apparatus in the form of a valve (140) comprises a body (148) defining a bore (168) with a curved disc closure member (142) positioned in the bore. First and second retaining members (144, 146) are positioned on respective sides of the disc (142) for retaining the disc in a closed position and to hold pressure from both sides. One of the retaining members (144) is retractable to permit opening of the valve disc (142). The disc (142) may be locked closed by locking the retractable retaining member (144) in position. On release of the member (144), application of fluid pressure to portions of the member (144) will retract the member (144).

11 Claims, 8 Drawing Sheets

20
24
30
26
2
2
31
34
22
25
36
22
31

37
64
32
33
40
46
44
38
58
52
36
50
60
42
56
42
31
22
26
30

DOWNHOLE APPARATUS FOR CONTROLLING FLUID PRESSURE

CROSS-REFERENCE TO RELATED APPLICATION

This application is a continuation of Ser. No. 09/117,513, filed Mar. 3, 1999, now U.S. Pat. No. 6,230,808.

This invention relates to apparatus for use in downhole operations. In particular, but not exclusively, the apparatus relates to an isolation valve intended for use in completion testing and in operations which take place immediately following completion testing.

In the oil and gas exploration and extraction industries, deep bores are drilled to gain access to hydrocarbon-bearing strata. The section of bore which intersects this strata or "production zone" is typically provided with a steel "liner", while the section of bore extending to the surface is lined with steel "casing". Oil and gas is extracted from the production zone through production tubing extending through the casing from the upper end of the liner. The production tubing is formed of a string of threaded sections or "subs" which are fed downwards from the surface, additional subs being added at the surface until the string is of the desired length. As the string is assembled and fed into the bore its pressure integrity, or "completion", is tested at regular intervals. Such testing is also carried out on the complete string. The testing is accomplished by pressurising the internal bore of the string. Of course this requires that the string bore is sealed at its lower end.

This sealing of the string bore is generally accomplished using a valve or plug which will normally remain closed or in place once testing is completed, to allow the packers mounted on the string to be set to locate and seal the string within the casing or liner. The valve or plug may then be opened or removed to permit formation fluid to flow upwardly to the surface through the production tubing. The opening or removal operation generally requires running in of an appropriate tool on, for example, wireline or coiled tubing, which will involve additional time and expense.

It is among the objectives of embodiments of this invention to obviate or mitigate these disadvantages. It is a further objective of embodiments of this invention to provide an isolation valve which will hold pressure in two directions, that is from the sump side and the surface side.

According to a first aspect of the present invention there is provided a downhole valve comprising a body defining a bore, a valve closure member positioned in the bore, first and second retaining members positioned on respective sides of the valve closure member for retaining the valve closure member in a closed position and to hold pressure from both sides, one of the retaining members being retractable to permit opening of the valve closure member.

In use, such a downhole valve will hold pressure from both the surface side and the sump side. The terms "above" and "below" are used herein, but those of skill in the art will of course realise that the invention may be used with equal utility in inclined or horizontal bores, and the orientation of the valve may be varied.

Preferably, with the valve closure member in the open position, the body defines a slick bore.

Preferably also, the valve closure member comprises a flapper in the form of a disc. Most preferably, the disc is in the form of a curved or concave disc. In the preferred embodiment a convex surface of the disc engages a valve seat.

Preferably also, one of the retaining members is extendable to maintain the valve closure member in an open position and to provide a slick bore. In the preferred embodiment one of the retaining members is both retractable, to permit opening of the valve closure member, and extendable to maintain the valve closure member in the open position.

Preferably also, one of the retaining members incorporates a valve seat. The valve seat may include an elastomeric seal located in an end surface of the retaining member. Most preferably, the retaining member incorporating the valve seat is non-retractable. Alternatively, a separate valve seat may be provided.

Preferably also, the retractable retaining member is moveable by application of fluid pressure thereto. The fluid pressure may be provided by well fluid in the borehole, and most preferably by the well fluid in the body bore. The supply of fluid from the body bore to actuate the retaining member may be controlled by an appropriate valve, such as described in PCT/GB95/02046.

Preferably also, the retractable retaining member includes a sleeve portion defining a piston, such that application of fluid pressure between the sleeve portion and the body tends to retract the member from a retaining position. The member may be biassed towards the retaining position by biassing means, such as a spring.

Preferably also, the retractable retaining member is lockable in the retaining position, but is releasable, most preferably on application of actuating fluid pressure. Most preferably, the unlocking of the retractable retaining member is controlled by a ratchet assembly comprising first and second axially relatively movable parts, each part defining a toothed face, and a ratch member located between the toothed faces, pressure induced reciprocal movement of the parts advancing the ratch member axially along the toothed face of the first part, in an advanced position the ratch member engaging a unlocking member such that further movement of the first part actuates the unlocking member to release the retaining member.

Additionally, or alternatively, the retractable retaining member may be releasable by application of physical force by a further tool located in the bore. Preferably, the unlocking member defines a tool engaging profile for cooperating with said further tool.

Preferably also, the retractable retaining member may be latched in the retracted position, to permit opening of the valve closure member, and then released to return to an extended position to maintain the valve closure member open.

Preferably also, the valve closure member is in the form of a flapper and is mounted on a valve carriage which, with the retaining member retracted, is axially movable towards the retaining member such that the retaining member may contact the flapper and push the flapper towards the open position. The valve carriage and the retaining member are preferably connected by a resilient link. In the preferred embodiment, retraction of the retaining member is achieved by pressurising the bore, which also maintains the valve carriage and flapper in the closed position, with the flapper in sealing contact with the other retaining member. Bleeding off bore pressure following retraction of the retaining member allows the flapper to lift from the other retaining member and the valve carriage to follow the retracted retaining member, and the end of the retaining member to contact the flapper and push the flapper to the open position.

The valve may include vent means for equalising pressure across the valve closure member prior to the retractable retaining member permitting opening. The vent means may be openable by initial application of fluid pressure, to permit fluid communication across the valve member. Most preferably, the vent means includes a moveable member, such as a sliding sleeve, which initially closes a vent passage but is moveable to open the passage. Preferably also, the moveable member also serves, in its initial position, to lock the retractable retaining member in the retaining position.

The other of the retaining members may be biassed to move the valve closure member to the open position. Alternatively, the valve closure member may be provided with means for biassing the member towards the open position.

According to another aspect of the present invention there is provided a method of completing a downhole string including the steps of:

providing a valve in a tubular string, which valve is capable of holding pressure from both above and below;

running the string into a bore with the valve closed;

securing the string in the bore; and opening the valve to permit flow of fluid through the string.

Conventionally, in a completion operation, the string is provided with a normally-closed valve which opens in response to higher pressure in the well to permit well fluid to flow into the string. Thus, such valves are not suitable for use as safety valves, and separate safety valves must be provided in the string to safeguard against surges of fluid up through the string when upper end of the string is opened. A valve which will hold pressure from both the sump and surface sides allows for completion testing against the valve and may also serve as a safety valve. In the method of this aspect of the invention top filling may be utilised for filling the string with fluid as it is run into the bore.

According to a further aspect of the present invention there is provided a downhole valve comprising: a curved valve closure member defining a convex face and a seal area on said face; and a valve seat for engaging the seal area.

Preferably, the valve includes a tubular valve body having a main axis and the seal area defines a surface which is substantially perpendicular to said axis.

According to a still further aspect of the present invention there is provided a downhole valve for holding fluid pressure in a first direction, the valve including a non-planar valve closure member defining a peripheral seal surface and a valve seat having a corresponding sealing area, the seal surface and sealing area being substantially perpendicular to said first direction.

It has been found that the sealing capabilities of valves in accordance with this aspect of the invention compare favourably in comparison with valves in which the seal surface simply coincides with the surface of the valve closure member.

Preferably, the valve closure member is a curved flapper, and most preferably the seal surface is provided at the periphery of the convex face of the member.

Preferably also, the sealing area includes a resilient sealing portion.

According to a yet further aspect of the present invention there is provided a ratchet arrangement for downhole apparatus, the arrangement comprising first and second parts, each part defining a toothed face, and a ratch member located between the toothed faces, the parts being axially relatively movable by application of fluid pressure thereto, wherein reciprocal movement of the parts advances the ratch member axially along the toothed faces.

The ratch member may engage a part of another tool or device on reaching an advanced position, and serve to actuate the tool or device or transfer force thereto from one of the parts. In a preferred embodiment the ratch member is utilised to transfer force from the first part to unlock a further part of a valve to permit opening of the valve.

Preferably, the first part defines a piston and is movable on application of fluid pressure thereto, and the first part has a stroke corresponding to the tooth spacing on the toothed faces of the parts such that each pressure cycle will advance the ratch member one tooth. Accordingly, by providing a known number of teeth and knowing the initial position of the ratch member, the ratch member may be moved to a predetermined advanced position by application of a predetermined number of pressure cycles. This feature is useful when used in conjunction with pressure actuated tools for use in completion operations, where pressure is used in, for example, completion testing and setting packers. Using this aspect of the invention, the operation of a particular pressure actuated tool, such as an isolation valve, may be controlled by the ratchet assembly, and will only commence after a predetermined number of pressure cycles, thus accommodating completion testing operations and the setting of packers.

The piston and toothed face of the first part may be integral. Alternatively, the toothed face may form part of a unit, incorporating the other toothed face and the ratch member, which is separable from the tool or device provided in combination with the ratchet assembly.

Preferably, the ratch member comprises first and second portions and a spring portion acting therebetween to urge the first and second portions into engagement with the respective toothed faces. Preferably, the ratch member portions are combined as a single integral part.

These and other aspects of the present invention will now be described, by way of example, with reference to the accompanying drawings, in which.

Figures 1, 1A, 2, 3:
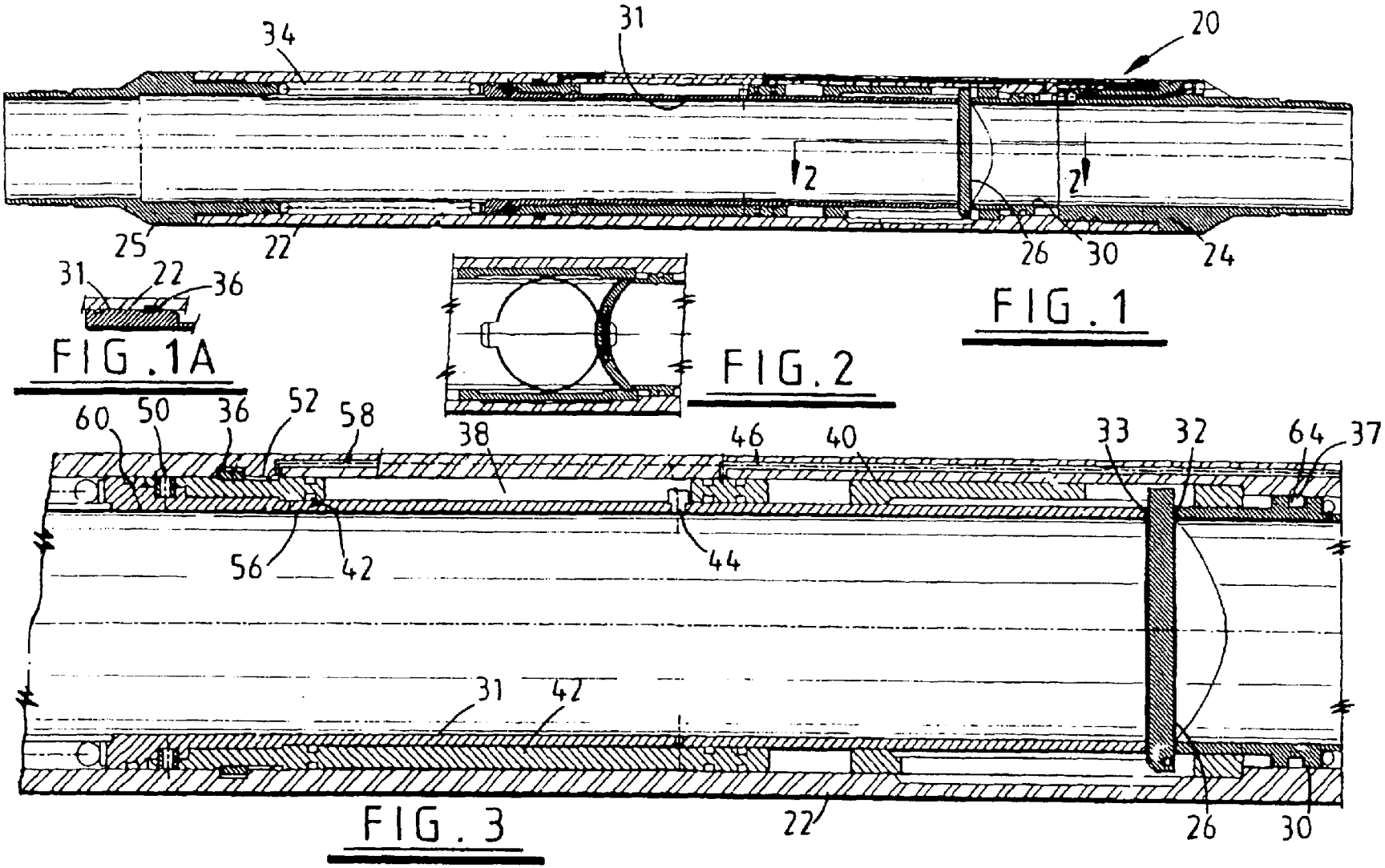
FIG. 1 is a sectional view of a downhole isolation valve in accordance with a first embodiment of the present invention.
FIG. 1A illustrates the true cross-section at area 1A of FIG. 1.
FIG. 2 is a sectional view on line 2—2 of FIG. 1.
FIG. 3 is an enlarged view of a portion of the isolation valve of FIG. 1, with the valve closure member in the closed position.
Figure 4:
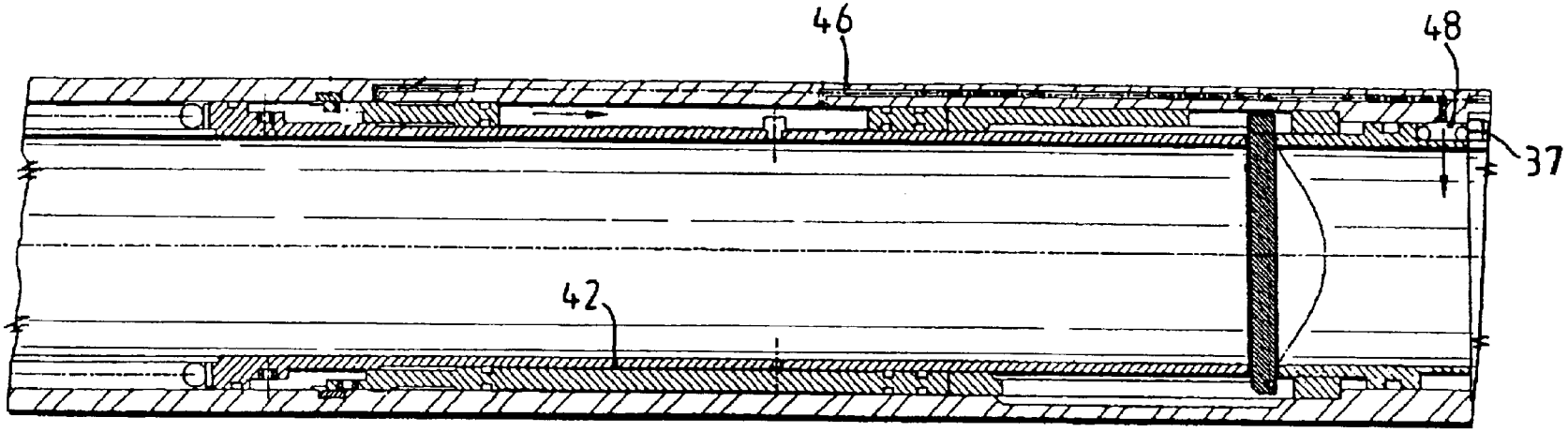
FIGS. 4, 5 and 6 are sectional views corresponding to FIG. 3, and illustrating the sequence of events culminating in the valve being locked open.
Figure 5:
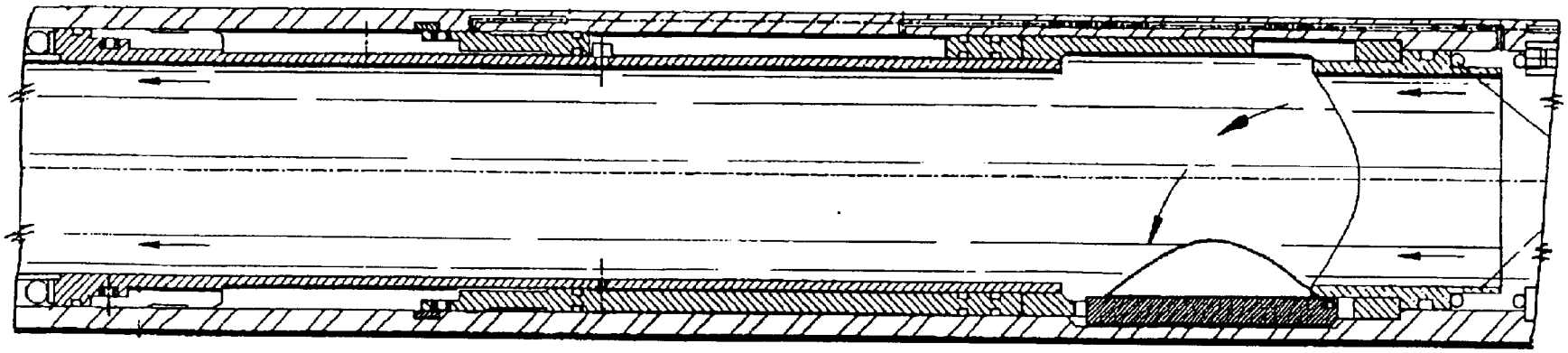
Figure 6:
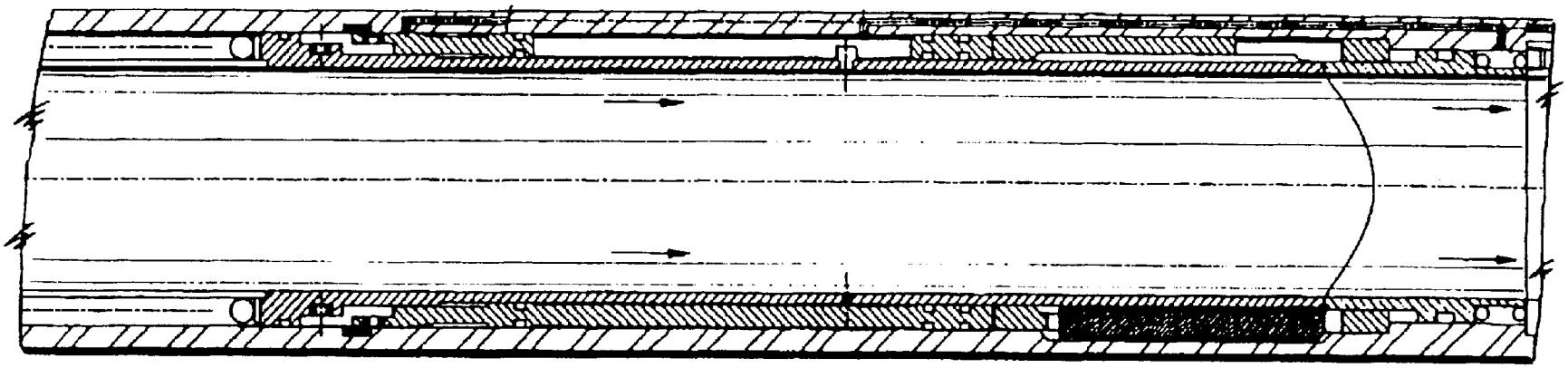

Reference is first made to FIGS. 1 to 6 of the accompanying drawings, which illustrate a downhole isolation valve 20 in accordance with a first embodiment of the present invention.

The isolation valve 20 comprises a tubular body 22 provided with upper and lower end caps 24, 25 provided with threaded ends for locating the body 22 in a tubular string (not shown). A valve member in the form of a concave circular disc 26 is mounted towards the upper end of the body 22, and is initially locked closed. The disc 26 seals against the ends of corresponding profiled upper and lower sliding sleeves 30, 31 defining respective seals 32, 33. The seals 32, 33 are pre-loaded by a compression spring 34 located on the lower or sump side of the disc 26, and acting between the lower end of the sleeve 31 and the lower end cap 25, to provide low pressure sealing. Pressure on the upper or surface side loads a snap ring 36 which locks the lower end of the sleeve 31 relative to the body 26 (see FIG. 1A for true cross-section at snap ring 36). Pressure from the sump side loads the upper end cap 24, via the upper sleeve 30. A compression spring 37 is provided between the upper end cap 24 and the upper sliding sleeve 30 and is used in opening the disc 26, as will be described.

There is an annular volume 38 defined between the inner wall of the body 22 and the outer wall of the lower sleeve 31. The volume 38 accommodates two sleeves: a disc mounting sleeve 40, to which the disc 36 is hinged and which is fixed to the body 22; and a sliding vent sleeve 42 which is axially movable within the volume 38. Rotational movement of the sleeve 42 is restricted by a guide pin 44 extending through the sleeve 31. In its initial position the vent sleeve 42 closes a vent passage 46 linking the volume 38 with a volume 48 on the surface side of the disc 26 which accommodates the spring 37. The sleeve 42 is initially fixed at the lower end of the volume 38 and is held in position by a shear pin 50. The sleeve 42 defines an annular groove 52 on its outer face which accommodates the snap ring 36 in its locked position. The sleeve 42 defines a shoulder 56 positioned above the outlet of a fluid passage 58 which communicates, through appropriate control lines and valves, to a supply of pressurised fluid or, most preferably, to a respective shuttle valve on a control tool as described in PCT/GB95/02046 or PCT/GB96/01907, the disclosures of which are incorporated herein by reference; the shuttle valve permits fluid communication between the body bore and the passage 58.

As noted above, the valve 20 is run in the closed position with the sump side compression spring 34 providing a low pressure sealing force. Pressure from the sump side acts over seals 32, 33 and also a seal 60 between the lower end of the sleeve 31 and the body 22. The load generated by this pressure is supported by the upper end cap 24. Pressure from the surface side acts over the seals 32, 33 and also the seal 62 between the upper end of the sleeve 30 and the body 22.

To open the valve 20, a control tool (not shown) as described above is subject to a predetermined number of pressure cycles to open the appropriate shuttle valve, allowing pressurised well fluid to flow into the passage 58. This pressure acts on the lower sliding vent sleeve shoulder 56, shears the pin 50 and moves the sleeve 42 upwardly in the volume 48 lifting the upper end of the sleeve 42 clear of the vent passage 46, and permitting fluid communication over the disc 26 and allowing the pressure to balance between each side of the disc 26. Upward movement of the sliding vent sleeve 42 also unlocks the snap ring 36.

With the snap ring 36 unlocked, the lower sliding sleeve 31 can now retract as the hydraulic fluid pressure force created in the volume 38 overcomes the biassing force produced by the spring 34. When the lower sleeve 31 is fully retracted, the upper sliding sleeve 30 forces the disc 26 open under spring force.

On hydraulic pressure being bled off from the volume 38, the lower sliding sleeve 31 is returned to its initial position by spring force. As the lower sliding sleeve 31 returns to its initial position it retains the disc 26 in the open position, and provides a slick bore.

Figure 7:
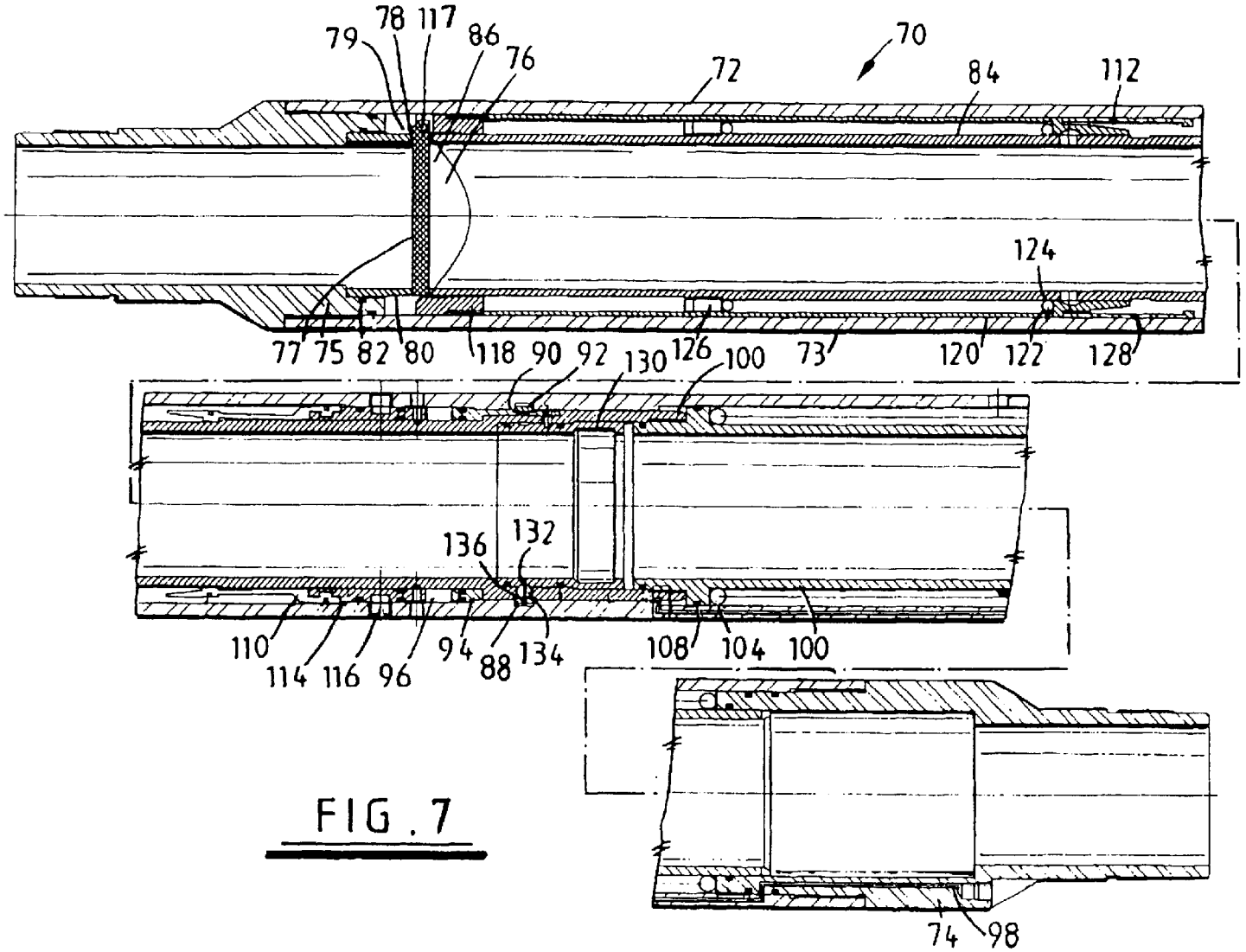
FIG. 7 is a sectional view of a downhole isolation valve in accordance with a second embodiment of the present invention.

Reference is now made to FIG. 7 of the drawings, which illustrates a downhole isolation valve in accordance with a second embodiment of the present invention. The valve 70 comprises a tubular body 72 comprising an outer sleeve 73 with upper and lower end caps or sleeves 74, 75 threaded to the ends thereof. A valve member in the form of a concave circular disc 76 is mounted towards the lower end of the body 72, and is initially locked closed, as illustrated in FIG. 7. In the closed position the convex disc surface 77 is in sealing contact with a valve seat 78 defined by the upper end of a lower retaining sleeve 80. The seat 78 includes a groove which accommodates an elastomeric seal 79. The lower end sleeve 75 provides a mounting for the retaining sleeve 80 and a sealing O-ring 82 is provided therebetween.

The disc 76 is retained in the closed position, against the valve seat 78, by an upper retaining sleeve 84 having a lower end which corresponds to the concave face 86 of the disc 76. Initially, with the disc 76 locked closed, the upper end of the retaining sleeve 84 is fixed against axial movement relative to the outer sleeve 73 by a split/snap ring 88 located in an external annular groove 90 in the sleeve 84 and engaging an internal groove 92 on the inner wall of the outer sleeve 73. Part of the retaining sleeve groove 90 is formed in the upper portion of an actuator sleeve 94, the lower portion of which is slightly enlarged and forms a piston within an annular chamber 96 between the outer wall of the retaining sleeve 84 and the inner wall of the outer sleeve 73. The space between the retaining sleeve 84 and the outer sleeve 73 above the actuator sleeve 94 is in communication with a pressurising fluid line for connection to a control line (not shown) linked to a pressurised fluid source. The control line leads into a fluid communication line 98 formed through the upper end sleeve 74 and which line 98 continues through the upper end of the outer sleeve 73 and opens into a small chamber 100 at the upper end of the retaining sleeve 84. Thus, application of fluid pressure through the line 98 into the chamber 100 will force the actuator sleeve 94 downwardly and push the split ring 88 radially outwardly and fully into the groove 92, thus unlocking the retaining sleeve 84 from the outer sleeve 73.

On release of the split ring 88, the retaining sleeve 84 will not be immediately retracted, as the sleeve 84 is biassed into the retaining position by a compression spring 104 provided in a spring housing 106 and which acts between the lower face of the upper end sleeve 74 and a shoulder 108 on the housing 106. However, by increasing the pressure that is applied through the line 98 into the chamber 100 an upwardly directed pressure force will act against the lower side of the spring housing shoulder 108 and above a predetermined bore/annulus pressure differential this pressure force will overcome the retaining spring force and retract the retaining sleeve 84. The retraction of the sleeve 84 continues until a set of latch fingers 110 engage an annular groove 112 on the outer surface of the retaining sleeve 84. The latch fingers 110 are mounted on a sleeve 114 located in the chamber 96 and which is fixed relative to the outer sleeve 73 by anchor pins 116.

The disc 76 is mounted, via a hinge pin 117, to a valve sleeve or carriage 118 which is axially movable within the chamber. The carriage 118 is threaded to the lower end of a trigger sleeve 120 linked to the retaining sleeve 84 via a compression spring 122; the spring 122 acts between a shoulder 124 towards the upper end of the sleeve 120 and a collar 126 fixed to the retaining sleeve 84. A retaining sleeve 128 extends upwardly from the upper end of the trigger sleeve 120.

When the retaining sleeve 84 is retracted as described above, by application of bore pressure through the line 98 to the chamber 100, and has been latched in the retracted position by the latch fingers 110, the pressure within the bore retains the disc 76 in the closed position and in contact with the valve seat 78. However, the relative axial movement between the retaining sleeve 84 and the valve carriage 118 on retraction of the sleeve 84 results in compression of the spring 122. Accordingly, as pressure is bled off from the bore, and the pressure differential across the disc falls, the disc 76 will be lifted from the valve seat 78 by the extension of the spring 122. The upward movement of the valve carriage 118 and disc 76 continues until the upper concave disc face 86 contacts the lower end of the retaining sleeve 84, which contact causes the disc 76 to be pivoted to the open position.

Once the disc 76 has been pushed to the fully open position, the upper end of the trigger sleeve 120 comes into contact with the latch fingers 110 and lifts the fingers 110 out of the groove 112 to latch with the finger retaining sleeve 128, such that the valve disc retaining sleeve 84 is free to move downwardly once more under the influence of the spring 104. The freed retaining sleeve 84 moves downwardly, to isolate the disc 76 between the sleeve and the outer sleeve 73, and also such that the lower end of the sleeve 84 comes into contact with the valve seat 78. The valve is now held in the open position, with the sleeve 84 defining a slick bore past the open disc 76.

In the event that, for whatever reason, it is not possible to open the valve solely by application of fluid pressure, a mechanical override sleeve 130 is provided within the valve bore at the upper end of the retaining sleeve 84. The outer wall of the sleeve 130 defines a groove 132. A number of balls 134 are provided in the groove and extend through corresponding openings 136 in the retaining sleeve 84 and contact the inner surface of the split ring 88. Accordingly, when the sleeve 130 is pulled upwardly using a suitable downhole tool, the balls 134 are pushed outwardly through the openings 136 to push the split ring 88 into the outer sleeve groove and release the retaining sleeve 84 from the outer sleeve 73. Further upward movement of the sleeve 130 will lift the retaining sleeve 84 and permit the disc 76 to open, as described above.

It will be evident that the valve 70 described above will hold pressure from both the surface and sump sides, but may be opened when desired either by application of bore pressure or by mechanical means, to provide an unrestricted or slick bore.

Figure 8:
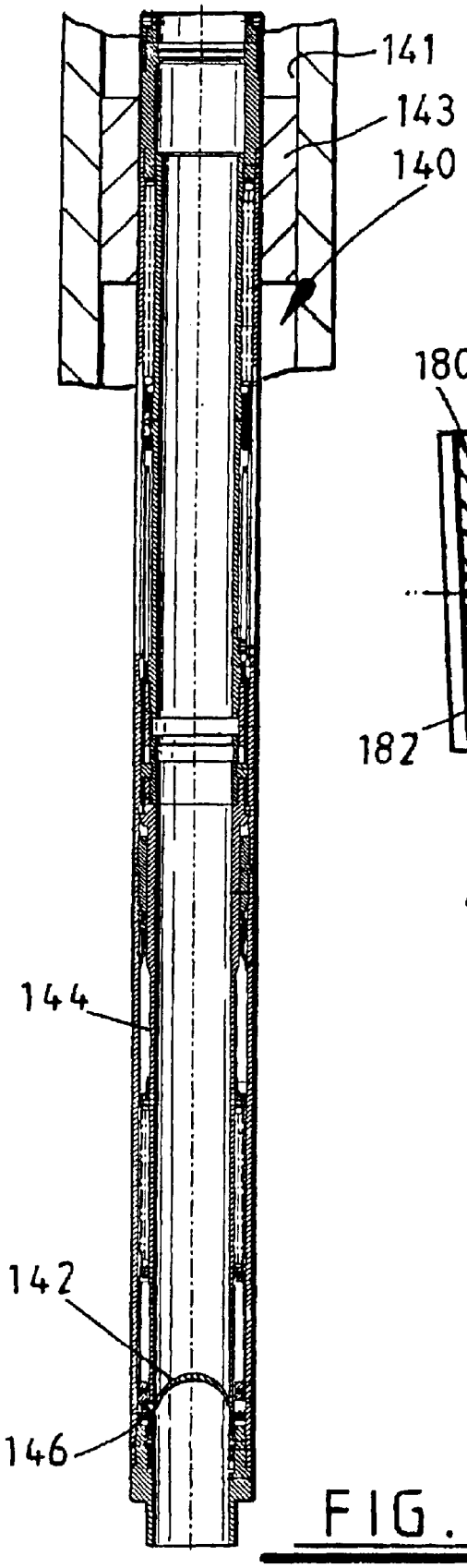
FIGS. 8 and 9 are sectional views of a downhole isolation valve in accordance with a preferred embodiment of the present invention.
Figure 9:
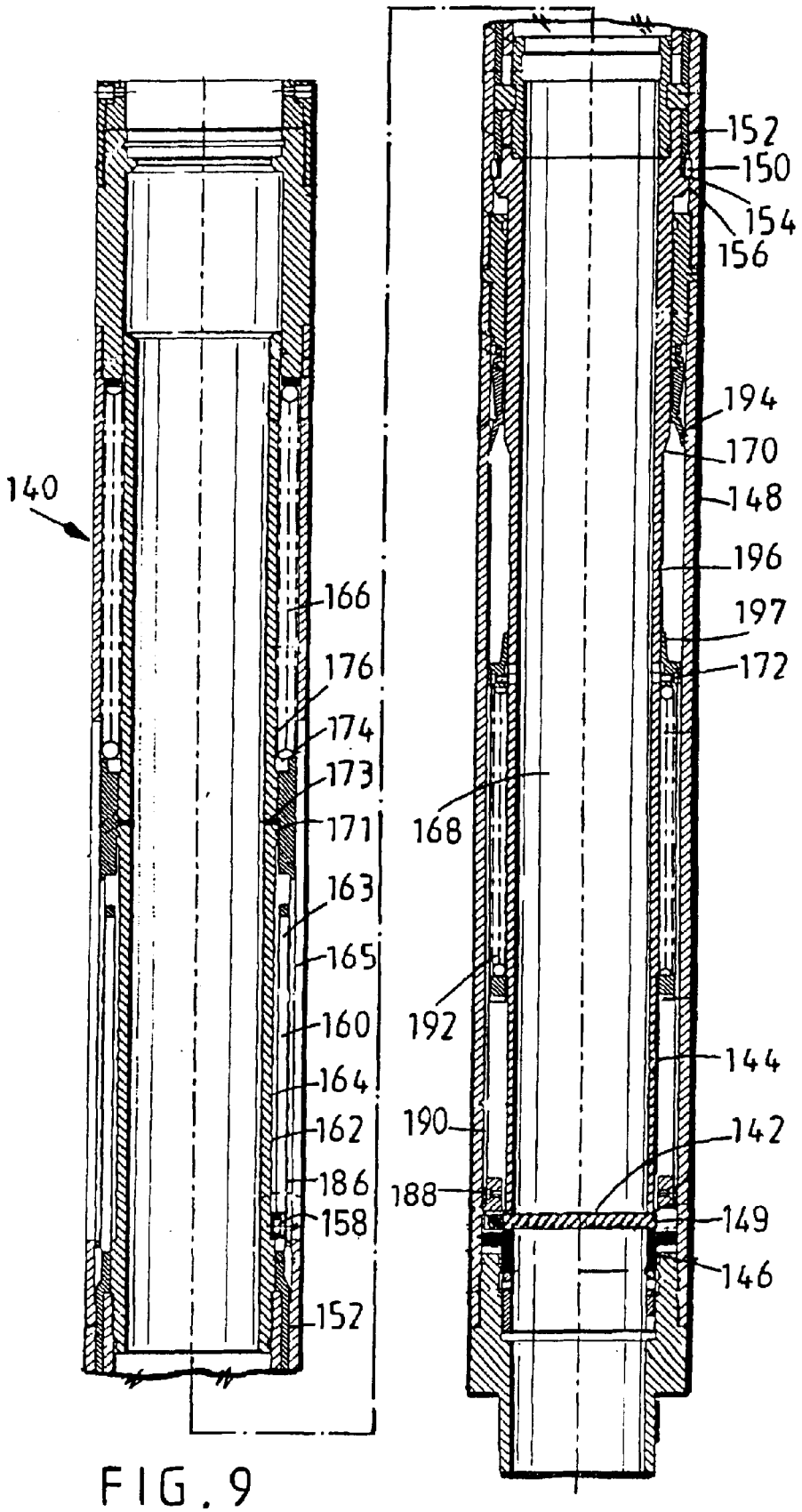
Figure 10:
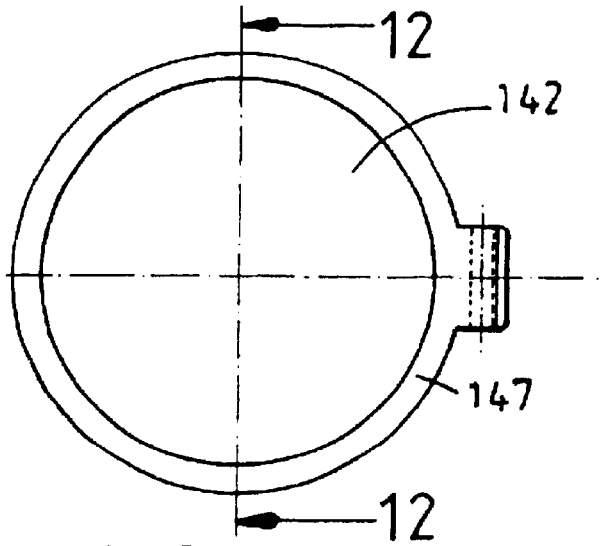
FIG. 10 is a view from below of the valve disc of the valve of FIG. 8.
Figure 12:
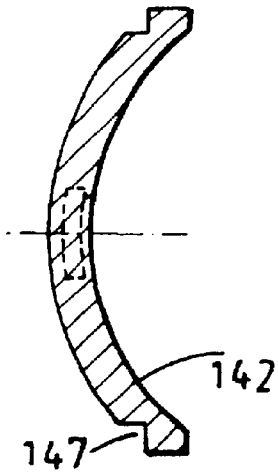
FIG. 12 is a sectional view on line 12—12 of FIG. 10.
Figure 11:
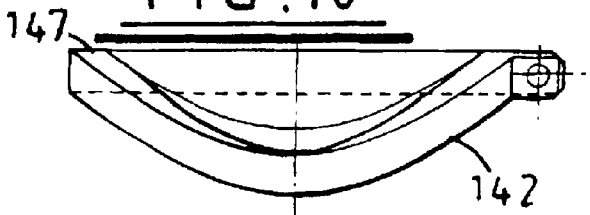
FIG. 11 is a side view of the disc of FIG. 10.
Figure 14:
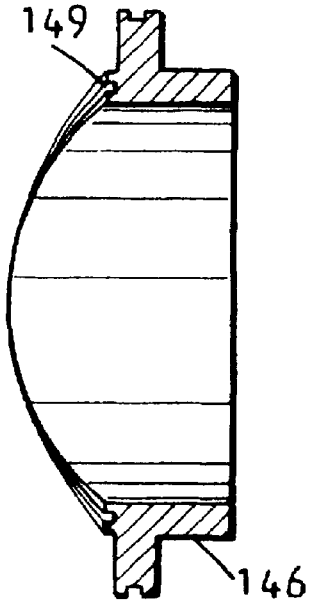
FIG. 14 is a sectional view on line 14—14 of FIG. 13.
Figure 13:
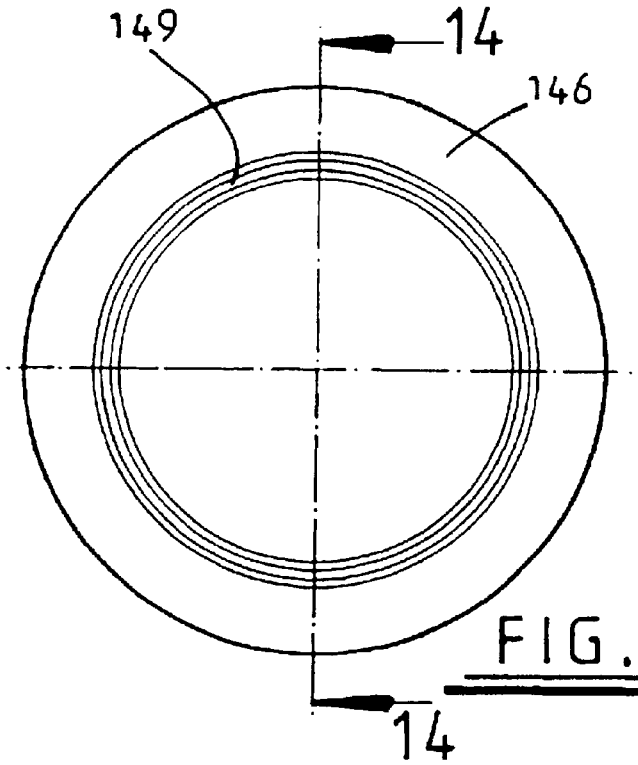
FIG. 13 is a plan view of the lower retaining sleeve of the valve of FIG. 8.

Reference is now made to FIGS. 8 and 9 of the drawings, which illustrate an isolation valve 140 in accordance with a preferred embodiment of the present invention. Like the embodiments described above, the valve 140 features a concave valve disc 142 and upper and lower retaining members or sleeves 144, 146, and the disc mounting and retaining arrangement is substantially similar to the valve 70. However, this valve 140 is operated in a somewhat different manner, in that the retractable retaining sleeve 144 is actuated by the pressure of well fluid directly above the disc 142 without requiring the provision of a separate control tool, and the control of the unlocking of the sleeve 144 is accomplished by an arrangement forming part of the valve 140, rather a separate control tool, as will be described. FIG. 8 illustrates the valve 140 in a well bore 141, positioned below a packer 143.

If reference is made also be FIGS. 10 to 14 of the drawings, the disc 142 and lower retaining member 146 are illustrated in greater detail. The concave disc 142 defines a peripheral sealing area 147 on its convex face which surface is perpendicular to the disc Z-axis. The sleeve 146 defines a corresponding valve seat 149, defining a groove to receive a resilient seal member.

As with the valve 70 described above, the retractable sleeve 144 is locked in position relative to the valve body 148 by a lock ring 150. A lock sleeve 152 holds the lock ring 150 in a radially extended configuration in a groove 154 in the valve body 148 and in this position a shoulder 156 defined by the sleeve 144 abuts the ring 150, restricting upward axial movement of the sleeve 144. The lock sleeve 152 may be lifted to release the lock ring 150, and thus release the retaining sleeve 144, by a ratch member 158 which is movable along an axial slot 160 in the lock sleeve 152. The ratch member 158 is located between two opposing toothed surfaces 162, 163 provided on respective sleeves 164, 165. The inner sleeve 164 is threaded to the upper end of the retractable retaining sleeve 144, while the outer sleeve 165 is movable independently of the sleeve 144, but is biassed downwardly by a compression spring 166 which acts between the upper end of the sleeve 165 and a shoulder formed on the valve body 148. The interaction of the ratch member 158 with the toothed surfaces 162, 163, allows a number of pressure cycles to be applied to the valve 140 before the retaining sleeve 144 is unlocked to allow opening of the disc 142, as described below.

When the spring and thus the valve bore 168 is pressurised, fluid pressure acts on two piston areas 170, 171. The first piston area 170 is formed on the retractable retaining sleeve 144 and is in communication with the valve bore 168 via ports 172. However, while the sleeve 144 is locked relative to the valve body 148 by the lock ring 150, no movement of the sleeve 144 may take place. The second piston area 171 is defined by the sleeve 165 and is in communication with the valve bore 168 via ports 173 in the inner sleeve 164. Application of a fluid pressure force to the piston area 171 lifts the sleeve 165, against the action of the spring 166, until a split collar 174 located in an annular groove in the upper end of the sleeve 165 engages a shoulder 176 defined by the inner sleeve 164. This "stroke" of the sleeve 165 corresponds to the length of one of the teeth of the toothed surface 163. Thus, as the sleeve 165 is lifted by application of well fluid pressure, the ratch member 158 is also lifted a corresponding distance, however when the fluid pressure in the valve bore 168 is reduced, and the spring 166 moves the sleeve 165 downwards, the ratch member 158 is retained in its advances position by the toothed surface 162 of the inner sleeve 164.

Figure 15:
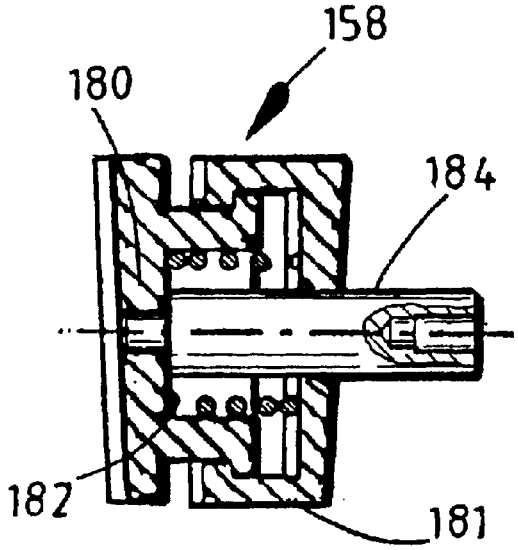
FIG. 15 is an enlarged sectional view of a ratch member of the valve of FIG. 8 (on the same sheet as FIG. 8)

If reference is made to FIG. 15 of the drawings, it will be noted that the ratch member 158 comprises two inter-fitting part annular segments 180, 181 which are urged into a radially extended position by a coil spring 182. A guide pine 184 is fixed to the inner segment 180, and extends through an opening in an outer segment 181. The pin 184 corresponds with an axial slot 186 in the outer sleeve 165.

With each pressure cycle that is applied to the string, the ratch member 158 is advanced one step along the inner sleeve toothed surface 162. After a predetermined number of cycles, the ratch member 158 reaches the end of the lock sleeve groove 160, such that the next increase in pressure within the string and valve bore 168 will result in the ratch member 158 lifting the lock sleeve 152, allowing the lock ring 150 to contract radially, and thus freeing the retaining sleeve 144 from the valve body 148. The subsequent sequence of events is similar to that described with reference to the valve 70 described above, as described briefly below.

Once the retaining sleeve 144 has been released from the body 148, the fluid pressure acting on the piston area 170 will tend to lift the sleeve 144 relative to the valve body 148, bringing the inner sleeve 164 into contact with the outer sleeve 165 at the piston area 171, such that subsequent movement of the sleeve 144 is resisted by the action of the spring 166. While the sleeve 144 moves upwardly, the disc 142 is maintained in contact with the valve seat 149 defined by the lower member 146 by the pressure acting downwardly on the disc 142. As with the above-described embodiment, the disc 142 is mounted on a carriage 188 linked to the sleeve 144 via a trigger sleeve 190 and a spring 192. The retraction of the sleeve 144 continues until latch fingers 194 mounted on the valve body 148 engage a profile 196 on the sleeve 144.

If pressure is then bled off from the valve bore 168 above the disc 142, the pressure force maintaining the disc 142 in contact with the lower seat falls, until, when the pressure across the disc 142 is almost equalised, the spring 192 lifts the carriage 188 and disc 142 towards the end of the sleeve 144. The upper surface of the disc 142 will then be brought into contact with the lower end of the sleeve 144 and will be pushed into the open position. When the disc 142 is fully open, a trigger nose 197 provided on the upper end of the trigger sleeve 190 releases the latch fingers 194, such that the action of the spring 166 pushes the sleeve 144 downwardly to retain and isolate the disc 142 in the open position.

Reference is now made to FIGS. 16 to 20 of the drawings, which illustrate part of a valve 198 and a modified ratch assembly 200, in accordance with aspects of the present invention. The ratch assembly 200 operates in a manner which is substantially the same as the ratch assembly described above, however, this assembly 200 includes a unit 202 (FIG. 18), consisting of the first and second toothed tracks 204, 205 and the ratch member 206, which is removable from the remainder of the device. The sleeve 208 incorporating the piston 210 which induces movement of the first toothed track 204 is mounted on the valve, separately from the unit 202, and may be connected to an upper portion of the track 204 using an appropriate fastener.

Figure 17:
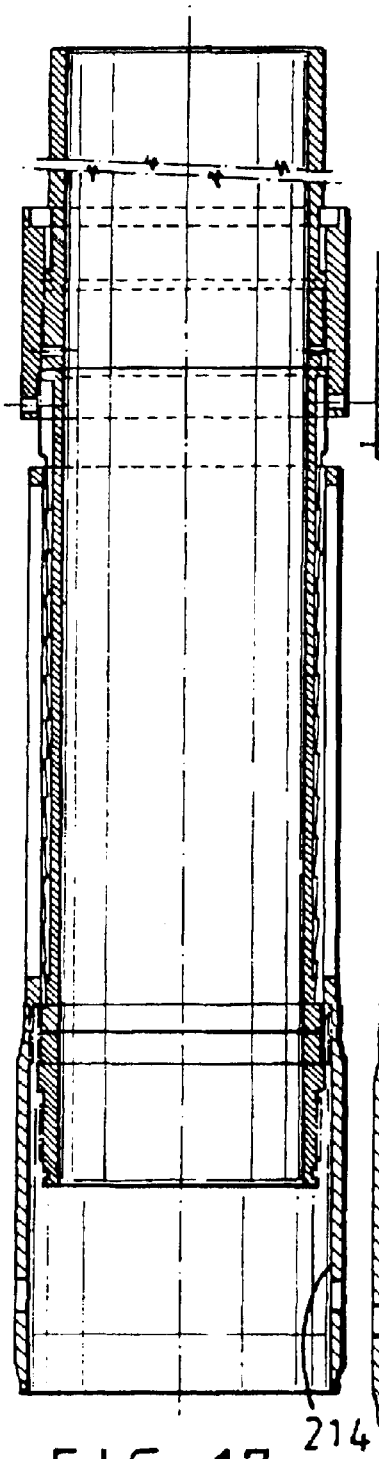
FIGS. 16 and 17 are sectional views of a portion of a valve for incorporating a ratch assembly in accordance with a preferred embodiment of another aspect of the invention.
Figure 16:
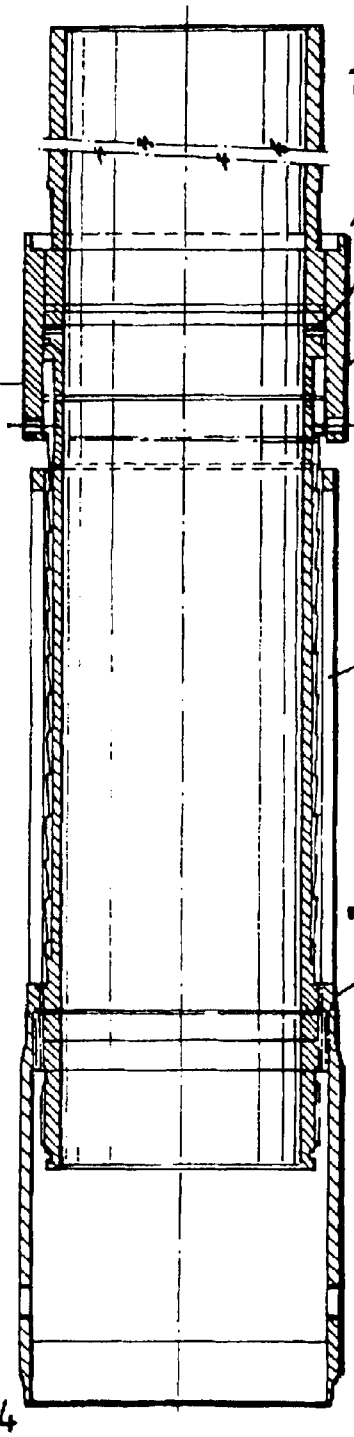
Figure 18:
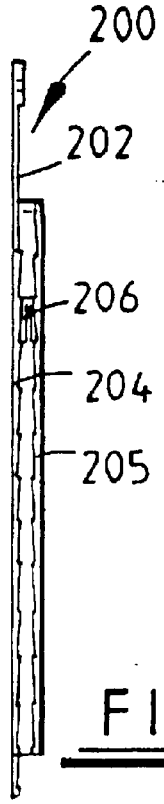
FIG. 18 is a side view of a ratch assembly for incorporation with the valve of FIG. 16.
Figure 19:
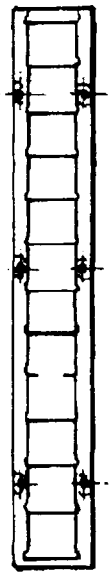
FIG. 19 is an end view of a toothed track of the assembly of FIG. 18.
Figure 20:
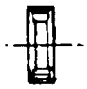
FIG. 20 is a plan view of the ratch assembly of FIG. 18.

The unit 202 is located in the valve by passing the unit 202 through a suitable door in the valve body (not shown) into a longitudinally extending aperture 212 in an upper portion of the unlocking member 214 (FIG. 17 illustrates the position of the unlocking member 214 after it has been lifted by the ratch member 206).

The ratch member 206 is formed of a single wedge-shaped block of metal in which a key-hole slot has been cut to permit deformation of the block as it climbs the tracks 204, 205.

In use, two units 202 will be fitted to the valve after the assembled valve has been tested, such that there is no requirement to reset the ratch members following testing. This provides an additional advantage in that it is no longer necessary to form a slot in the valve body along the length of the toothed tracks, as required in the above described embodiment, to allowing resetting of the ratch member; the presence of the slot leads to a weakening of the valve body.

It will be clear to those of skill in the art that the valves described above may be used in many downhole applications, and offer many advantages over conventional isolation valves and plugs. The valves may be opened merely by appropriate application of bore pressure, and thus obviate the need for intervention using, for example, wireline mounted tools. Further, the valves may be located at any convenient location in a string and may be positioned below a packer or other apparatus if desired. It will further be clear to those of skill in the art that the above-described embodiments are merely exemplary of the present invention, and that various modifications and improvements may be made thereto without departing from the scope of the invention as defined in the appended claims.

What is claimed is:

1. A downhole valve comprising: a body defining a bore; a flapper valve in the form of an arcuate valve disc positioned in the bore and having a oppositely directed convex and concave surfaces; and first and second retaining members positioned on respective sides of the valve disc for retaining the disc in a closed position and to hold pressure from both sides, one of the retaining members being retractable to permit opening of the disc, wherein the convex surface of the disc engages a valve seat.

2. A downhole valve comprising:

a body defining a bore;

a valve closure member positioned in the bore;

first and second retaining members positioned on respective sides of the valve closure member for retaining the valve closure member in a closed position and to hold pressure from both sides, one of the first and second retaining members being retractable to permit opening of the valve closure member, the retractable retaining member including a sleeve portion defining a piston, such that application of fluid pressure between the sleeve portion and the body tends to retract the retractable retaining member from the closed position; and means for biasing the retractable retaining member towards the closed position.

3. A method of completing a downhole string, comprising:

providing a valve in a tubular string below a packer, said valve being capable of holding completion testing pressure from above and sump pressure from below;

running said string into a bore with the valve closed;

securing said string in the bore; and opening the valve to permit flow of fluid through said string.

4. The method of claim 3, further comprising: setting the packer before opening the valve.

5. A downhole valve comprising:

a curved valve closure member in the form of an arcuate valve disc and defining a convex face and an oppositely directed concave face and a seal area on said convex face;

a valve seat for engaging the seal area; and a tubular valve body having a main axis and said seal area defines a surface which is substantially perpendicular to said axis.

6. A downhole valve for holding fluid pressure in a first axial direction, the valve including a non-planar valve closure member defining a peripheral seal surface and a valve seat having a corresponding seal area, both the seal surface and the sealing area being substantially perpendicular to said first direction over substantially the entire circumferential extent of the seal surface and the sealing area.

7. The valve of claim 6, wherein the valve closure member is a curved flapper.

8. The valve of claim 7, wherein the seal surface is provided at the periphery of a convex face of the member.

9. The valve of claim 6, wherein the sealing area further includes a resilient sealing portion.

10. A downhole valve for holding fluid pressure in a fist axial direction, comprising:

a curved valve closure member having one side defining a predominantly concave face and an opposite side defining a predominantly convex face, said convex face defining a seal area;

said seal area substantially perpendicular to said first axial direction over substantially an entire circumferential extent of said seal area and extending around the periphery of said closure member; and a valve seat having a corresponding sealing area.

11. A downhole valve for holding fluid pressure in a first axial direction, the valve including a non-planar valve closure member defining a seal surface perpendicular to said first axial direction over substantially an entire circumferential extent of the seal surface and extending around a periphery of the closure member, and a valve seat having a corresponding sealing area.

* * * * *